US006481235B2

(12) United States Patent
Kwon

(10) Patent No.: US 6,481,235 B2
(45) Date of Patent: Nov. 19, 2002

(54) ICE MAKING DEVICE OF REFRIGERATOR

(75) Inventor: Hyeok Min Kwon, Gyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/922,104

(22) Filed: Aug. 6, 2001

(65) Prior Publication Data

US 2002/0014087 A1 Feb. 7, 2002

(30) Foreign Application Priority Data

Aug. 7, 2000 (KR) ..... 00-45735

(51) Int. Cl.[7] ..... F25C 1/12

(52) U.S. Cl. ..... 62/353; 249/70; 425/439; 425/440

(58) Field of Search ..... 62/72, 353; 249/66.1, 249/69, 70; 425/439, 440

(56) References Cited

U.S. PATENT DOCUMENTS

| | | | | | |
|---|---|---|---|---|---|
| 3,273,353 | A | * | 9/1966 | Horvay et al. | 249/70 |
| 3,677,030 | A | * | 7/1972 | Nicholas | 62/353 |
| 4,306,423 | A | * | 12/1981 | Webb et al. | 249/66.1 |
| 5,400,605 | A | * | 3/1995 | Jeong | 62/353 |
| 5,829,266 | A | * | 11/1998 | Lyu | 62/353 |

* cited by examiner

*Primary Examiner*—William E. Tapolcai
(74) *Attorney, Agent, or Firm*—Fleshner & Kim, LLP

(57) ABSTRACT

An ice-making device includes a case, an ice tray having a plurality of ice cubes and being rotatably installed clockwise and counterclockwise in the case, and a rotation stopping unit provided at the case and the ice tray to limit a rotation of an ice tray if the ice tray is rotated clockwise or counterclockwise within a predetermined angle in a state that the ice tray is poised horizontally. Since the ice tray can be rotated clockwise or counterclockwise according to a user's selection, the pieces of ice can be easily from the ice tray, ensuring that the user can separate the pieces of ice more conveniently.

19 Claims, 7 Drawing Sheets

ICE MAKING DEVICE OF REFRIGERATOR

BACKGROUND OF THE INVENTION

1. Field of the Invention

The present invention relates to an ice-making device of a refrigerator, and more particularly, to an ice-making device of a refrigerator that is capable of easily separating pieces of frozen ice from an ice tray by twisting the ice tray.

2. Description of the Background Art

FIG. 1 is a perspective view of a general refrigerator and front view showing that a door of the refrigerator is opened.

With reference to FIG. 1, a body of the refrigerator is divided into an upper freezing chamber (F) and a lower cooling chamber (R). The freezing chamber (F) and the cooling chamber (R) are opened and closed by doors 20 and 20' rotatably combined at the front side of the body 10.

Shelves 30 and 30' are installed at the inner side of the freezing chamber (F) and the cooling chamber (R) and door baskets 21 and 21' are installed at the inner side of the doors 20 and 20°, to keep various food stuffs, A food stuff or a storage container are received at the shelves 30 and 30' and at the door baskets 21 and 21'.

An ice-making unit 40 is installed in the freezing chamber to make an ice by concentrating cool air.

An ice storing box 50 is installed at a lower side in the freezing chamber (F), to store pieces of ice made by the ice-making unit 40.

The ice-making unit 40 and the ice storing box 50 are installed in a drawer type in the freezing chamber.

The conventional ice-making device will now be described with reference to FIGS. 2A, 2B and 3.

FIG. 2A is a perspective view showing an ice-making unit in accordance with the conventional art.

As shown in FIG. 2A, the ice-making unit 40 includes a rectangular frame shaped case 41 with an upper and a lower portions opened and an ice tray 42 having a plurality of ice cubes 42a and rotatably installed in the case 41.

The ice cubes 42a of the ice tray 42 is filled with water to make ice. That is, after the ice tray 42 is filled with water and kept in the freezing chamber (F) for a predetermined time, the water filled in the ice cubes 42*a* is changed to ice in a predetermined shape, thereby making ice.

With reference to FIG. 2B, when the ice tray 42 of the ice-making unit 40 is twisted by being rotated, pieces of ice made in the ice tray 42 can be separated.

That is, with reference to FIG. 3, a rotational shaft 42*b* is formed at the front side of the ice tray 42, penetrating the case 41 to be protruded outwardly, and a knob 43 is fixed at the front side of the rotational shaft 42*b*.

A rotational shaft 42*c* is formed at a rear side of the ice tray 42 and inserted into the case 41.

As to the ice tray 42, when the knob 43 is rotated, it is rotated inside the case 41 centering around the rotations shafts 42*b* and 42*c*.

A protrusion 41*a* is formed at the rear inner face of the case 41. The protrusion 41*a* is to render the ice tray 42 to be twisted by limiting the rotation of the ice tray 42 when the tray 42 is rotated clockwise by more than a predetermined angle.

Accordingly, when the user rotates the knob 43 clockwise, as shown in FIG. 2B, the ice tray 42 is rotated in the case 41 upside down to a degree.

At this time, since the rear portion of the ice tray 42 is caught by the protrusion 41*a,* it could be hardly rotated any further, but the front portion is rotatable.

In this state, when the user rotates the ice tray 42, the ice tray 42 is twisted, so that pieces of ice frozen in the ice tray 42 are separated from the ice cubes 42*d*.

The many pieces of ice separated from the ice cubes 42*a* fall down into the ice storing box 50 installed at the lower side of the ice-making unit as shown in FIG. 1.

An elastic member 44 is wound at the rotation shaft 42*c* of the ice tray 42. One side of the elastic member is supported by the protrusion 41*a* and the other there of is caught by the ice tray 42.

Accordingly, when the ice tray 42 is rotated clockwise, the elastic member 44 receives a compressive force, and in this state, when the user lets go of the knob, the elastic member 44 is restored, rotating the ice tray 42 counterclockwise to restore the ice tray 42 to its original horizontal state.

However, the ice-making device of the conventional art has the following shortcomings.

That is, typically, the ice tray 42 is constructed to be rotated clockwise in consideration of the fact that users are mostly right-handed. And, substantially, rotation counter-clockwise is limited by the protrusion 41*a*.

With such a structure that the ice tray 42 is rotatable in the uni-direction, it is impossible for the user to select a rotation direction, causing a problem that the user may not determine the rotation direction at his or her own discretion according to a use condition of the user.

For example, for a left-handed user who would rather feel comfortable to rotate the knob 43 counterclockwise, the ice-making unit 40 of the conventional art is much inconvenient to use.

In addition, unlike the case that the ice-making unit 40 is installed at the left side of the freezing chamber (F) as shown in FIG. 1, if the ice-making unit is installed near a hinge of the door 20 at the right side of the freezing chamber, the door 20 should be completely opened, because if the door is not completely opened, when the knob 43 is rotated clockwise, the ice-making unit would be interfered by the door basket 21.

SUMMARY OF THE INVENTION

Therefore, an object of the present invention is to provide an ice-making device having an ice tray that can be freely rotated in a desired direction for users' convenience, thereby improving a convenience of users.

To achieve these and other advantages and in accordance with the purpose of the present invention, as embodied and broadly described herein, there is provided an ice-making device including: a case; an ice tray having a plurality of ice cubes, rotatably installed clockwise and counterclockwise in the case; and a rotation stopping unit provided at the case and the ice tray to limit a rotation of an ice tray clockwise or counterclockwise within a predetermined angle in a state that the ice tray is poised horizontally.

In the ice-making device of the present invention, a knob is protruded at the front side of the ice tray and the case, and the rotation stopping unit is installed at the rear side of the ice tray and the case.

In the ice-making device of the present invention, the rotation stopping unit includes a stopping protrusion protruded from the ice tray and a guide groove formed at the case, for guiding a movement of the stopping protrusion so as to be inserted thereto and limiting a rotation of the ice tray within a predetermined angle.

The ice-making device of the present invention further includes an elastic unit formed between the case and the ice tray to provide an elasticity so that the ice tray can return to a horizontal state after being rotated clockwise or counterclockwise.

In the ice-making device of the present invention, a plurality of stopping protrusions and guide grooves are formed at the ice tray and the case.

In the ice-making device of the present invention, the stopping protrusions includes a first stopping protrusion and a second stopping protrusion having different distances, and the guide grooves include a first guide groove ad a second groove into which the first stopping protrusion and the second stopping protrusion are inserted, respectively.

In the ice-making device of the present invention, one stopping protrusion and one guide groove are formed both at the ice tray and the case.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
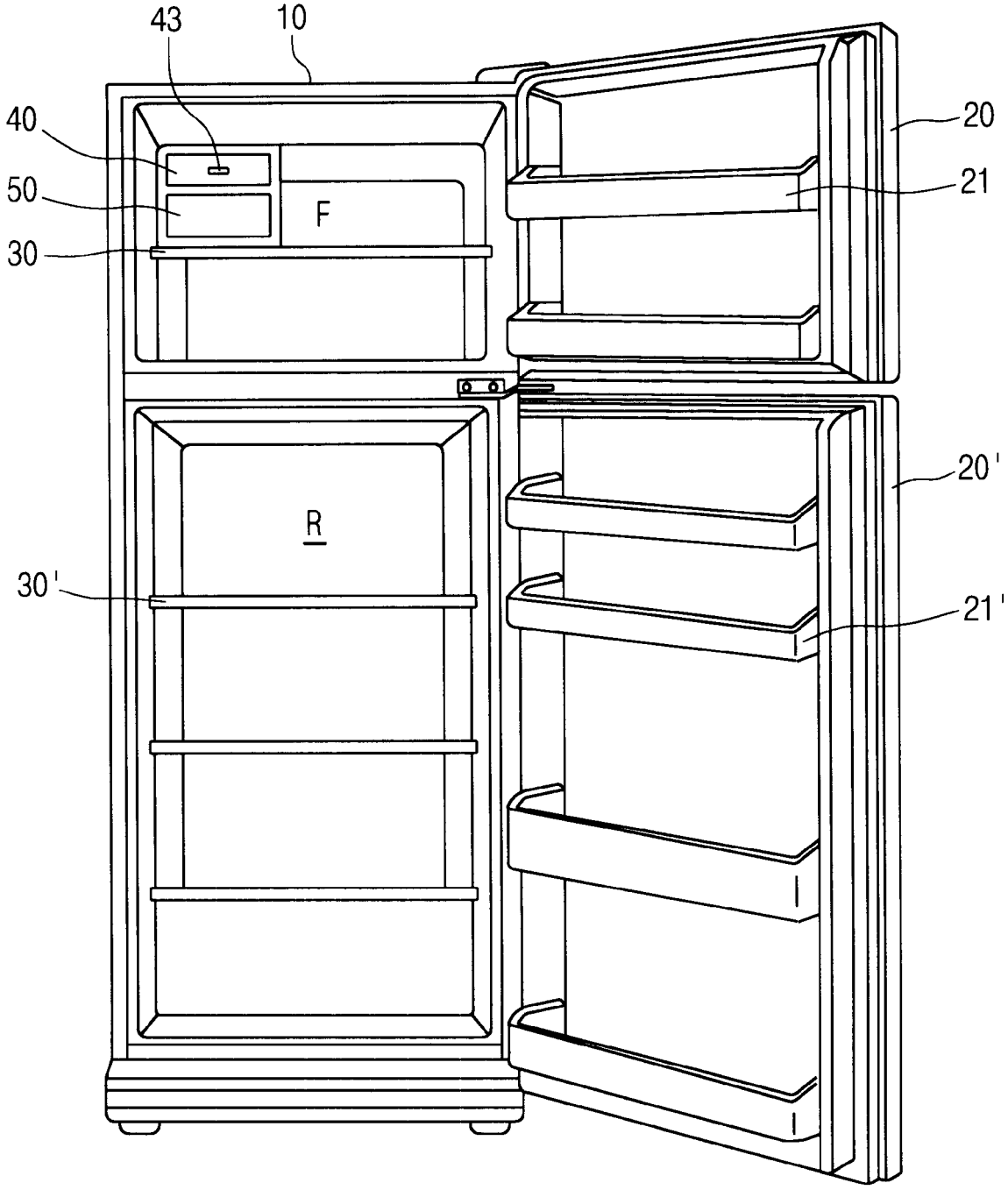
FIG. 1 CONVENTIONAL ART
FIG. 1 is a front view of a refrigerator having an ice-making device in accordance with a conventional art.
Figure 2A:
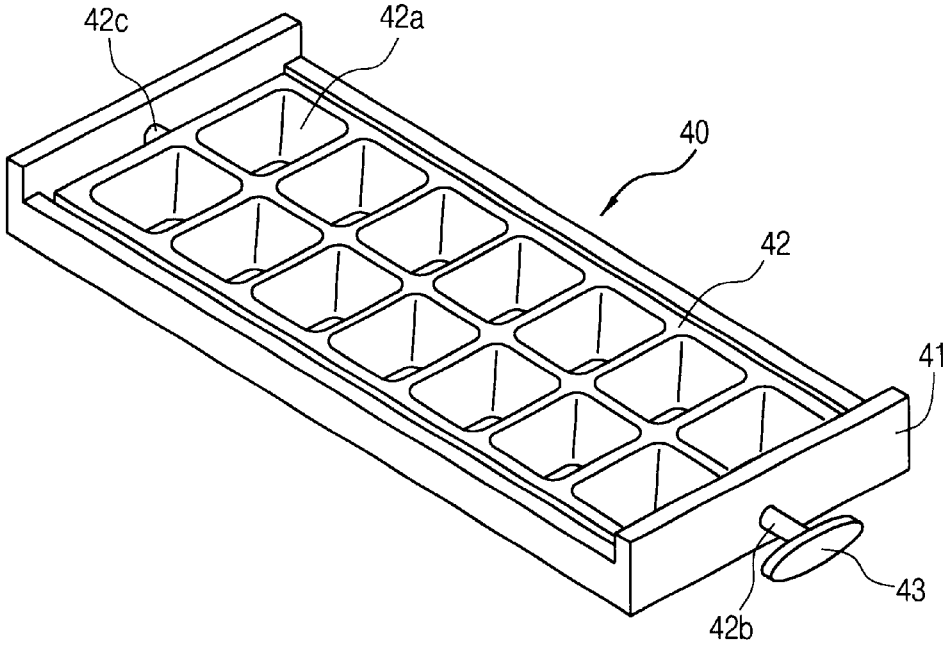
FIG. 2A CONVENTIONAL ART
FIG. 2A is a perspective view of an ice-making unit showing a state that ice is being made in accordance with the conventional art
Figure 2B:
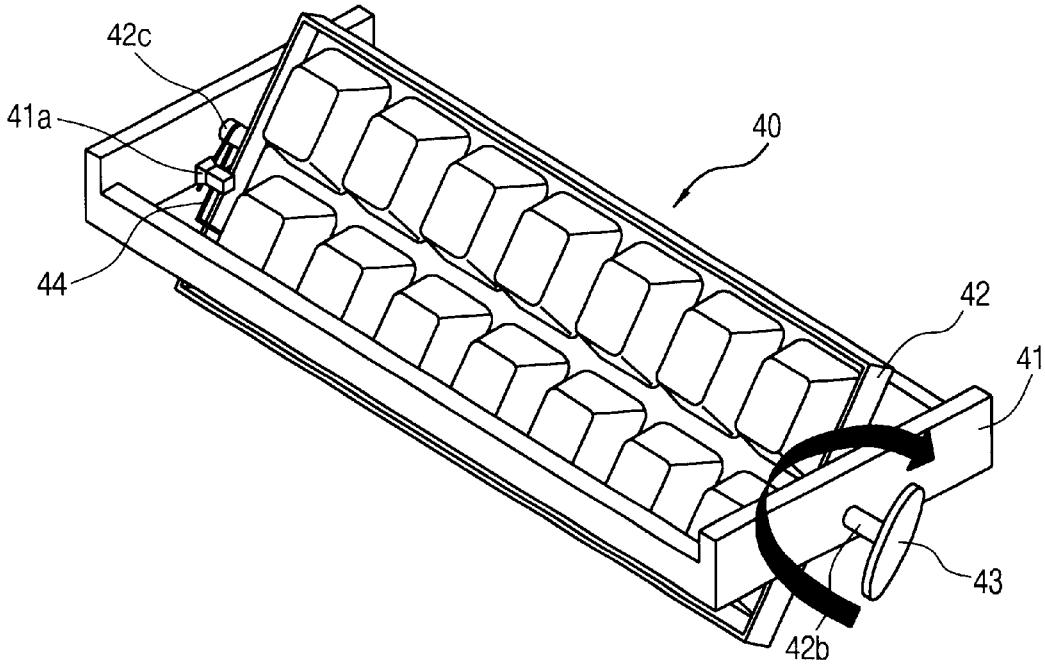
FIG. 2B CONVENTIONAL ART
FIG. 2B is a perspective view of the ice-making unit showing an operational state that ices are separated in accordance with the conventional art.
Figure 3:
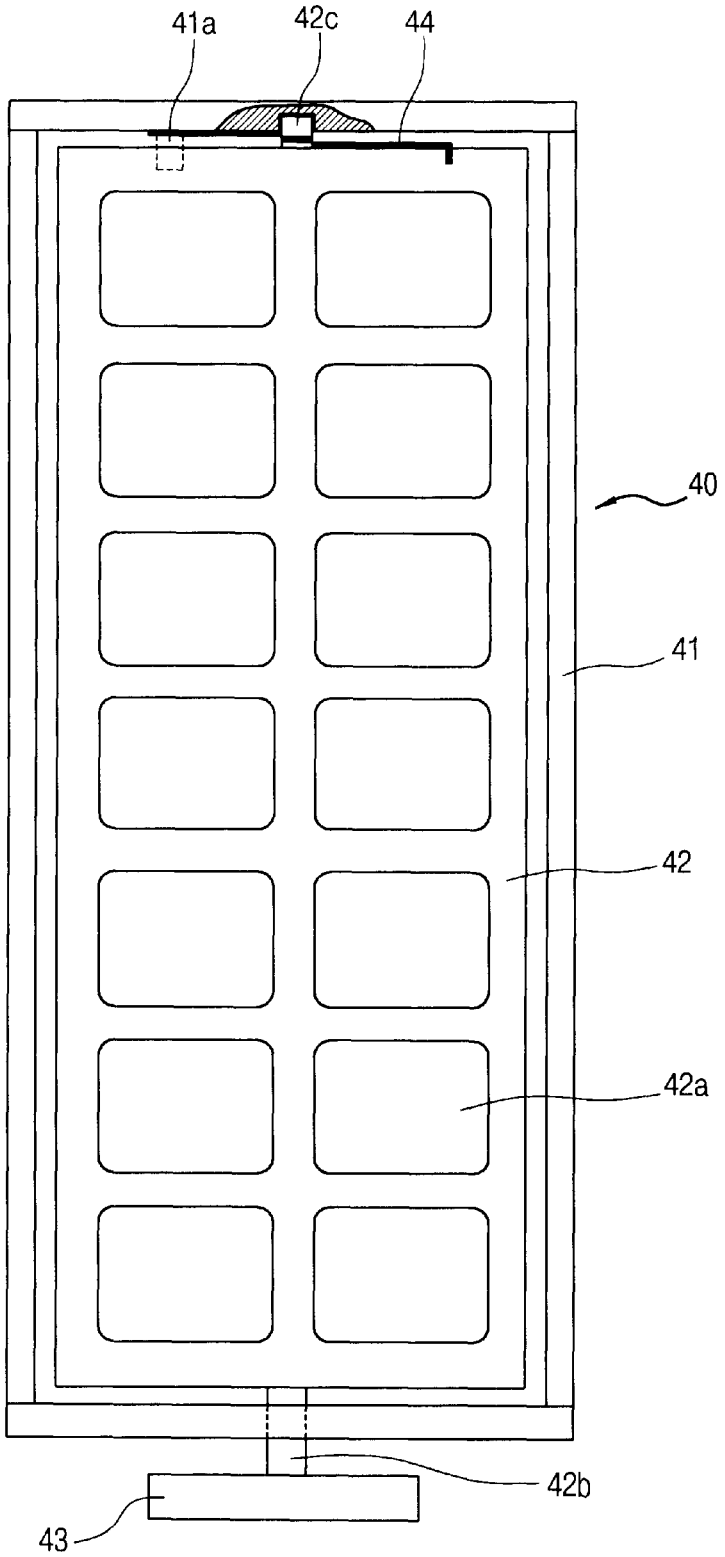
FIG. 3 CONVENTIONAL ART
FIG. 3 is a plan view of the ice-making unit in accordance with the conventional art.
Figure 4:
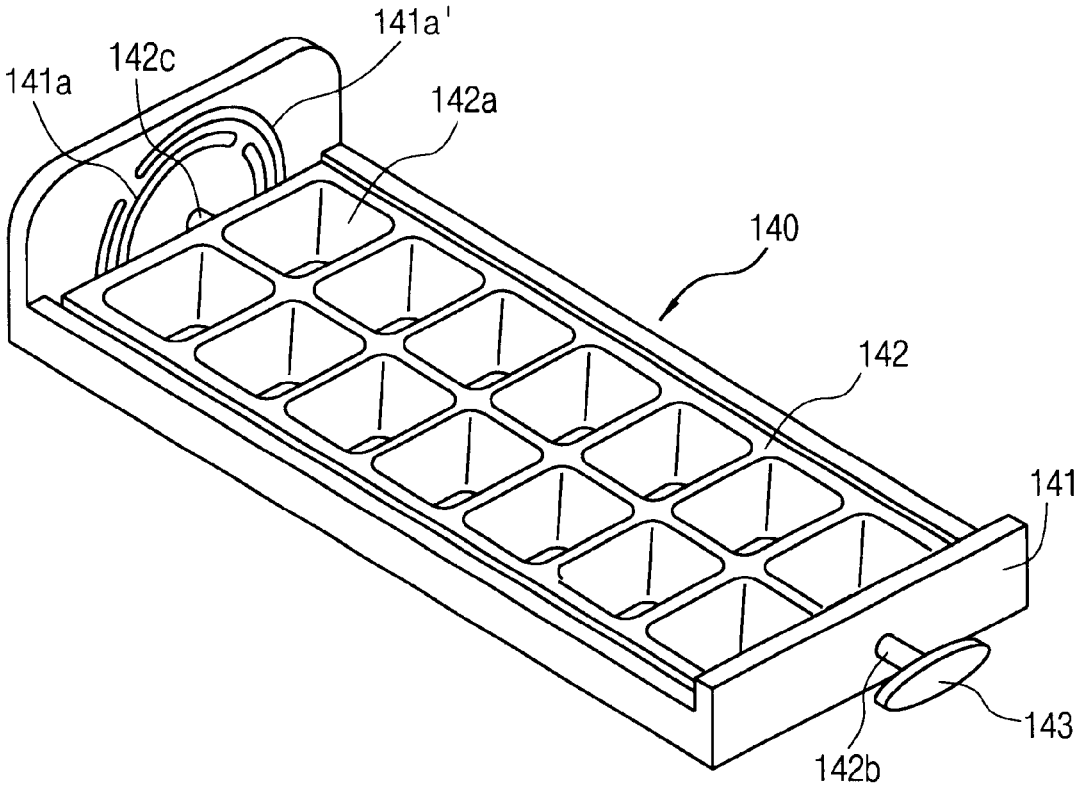
FIG. 4 is a perspective view of an ice-making device of a refrigerator in accordance with one embodiment of the present invention.

FIG. 4 is a perspective view of an ice-making device of a refrigerator in accordance with one embodiment of the present invention.

An ice-making unit 140 includes a rectangular case 141 with upper and lower sides opened, and an ice tray 142 rotatably installed in the case 141.

A plurality of ice cubes 142*a* are formed in th ice tray 142 and filled with water to make pieces of ice.

Rotational shafts 142*b* and 142*c* coupled to the case 141 are protrusively formed at the front side and the rear side of the ice tray 142.

The front rotational shaft 142*b* penetrates the case 141 and protruded outwardly to be fixed by a knob 143, and the rear rotational shaft 142*c* is inserted into the case 141.

That is, when the knob 143 is rotated by the rotational shafts 142*b* and 142*c* supported by the case 141, the ice tray 142 is rotated in the case 141.

Figure 5:
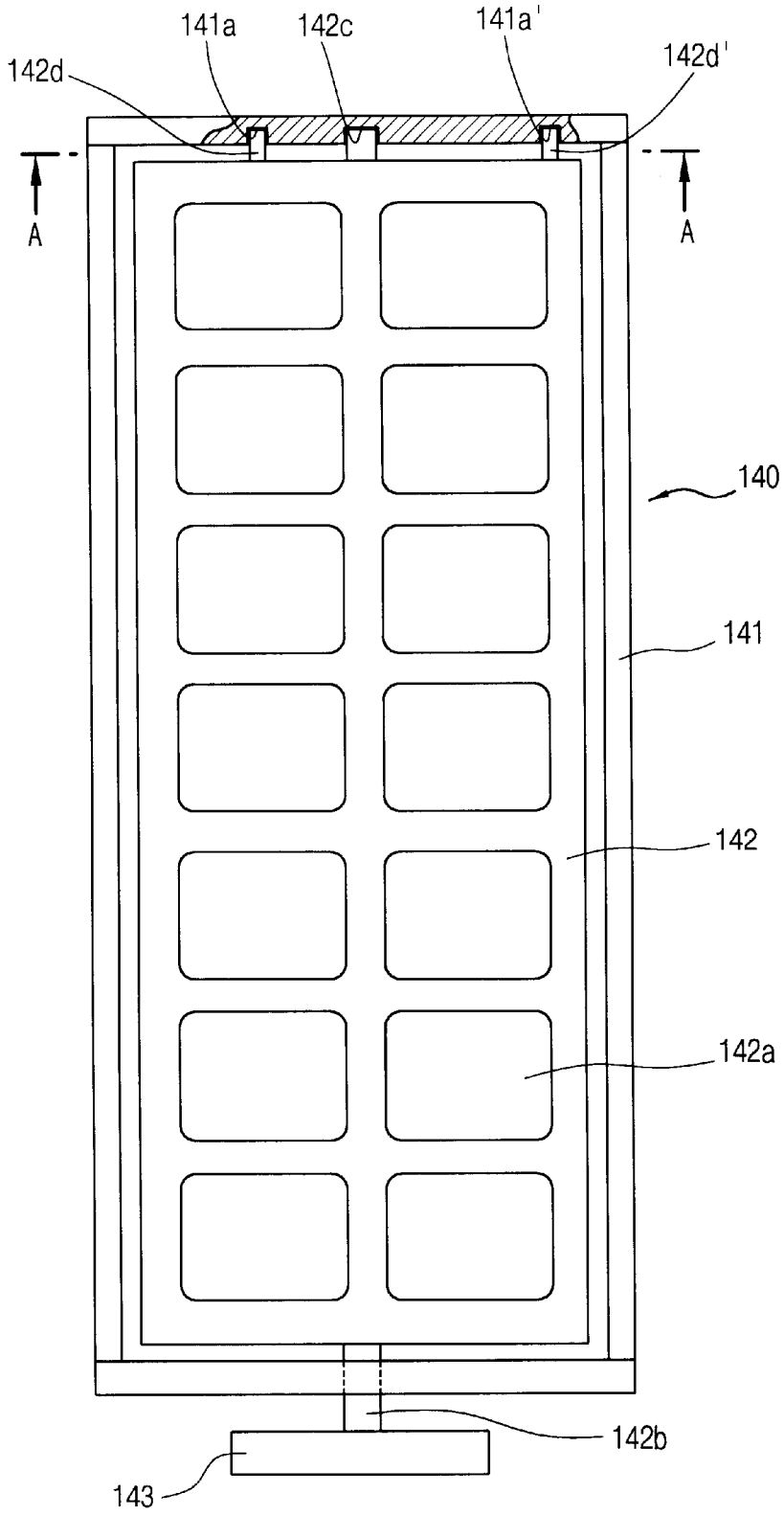
FIG. 5 is a plan view of an ice-making device of a refrigerator in accordance with one embodiment of the present invention.

As shown in FIG. 5, a first stopping protrusion 142*d* and a second stopping protrusion 142*d*' having a different distance from the rotational shaft 142*c* are formed at the left and right side of the rear rotational shaft 142*c* of the ice tray 142.

A first guide groove 141 a and a second guide groove 141 a are formed at the inner side facing the stopping protrusions 142*d* and 142*d*' of the case 141, so that the stopping protrusions 142*d* and 142*d*' are inserted thereto.

Figure 6:
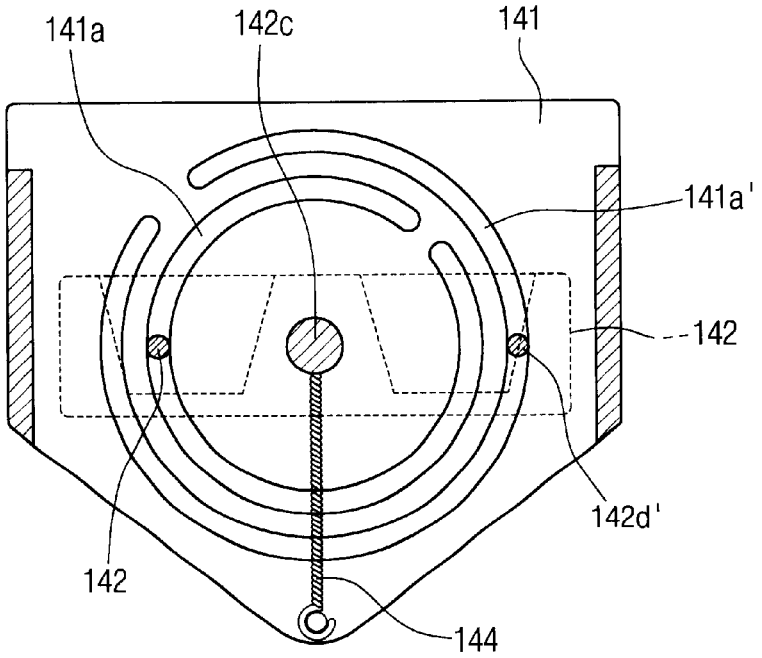
FIG. 6 is a view taken along line A—A of FIG. 5, showing a state when ice is being made in accordance with one embodiment of the present invention.

That is, as shown in FIG. 6, the first and the second guide grooves 141*a* and 141*a*' are formed in an arc shape, so that when the ice tray 142 is rotated clockwise or counterclockwise, they provide a movement path of the stopping protrusions 142*d* and 142*d*' and limits a rotation of the stopping protrusions 142*d* and 142*d*' within a predetermined angle.

Figure 7:
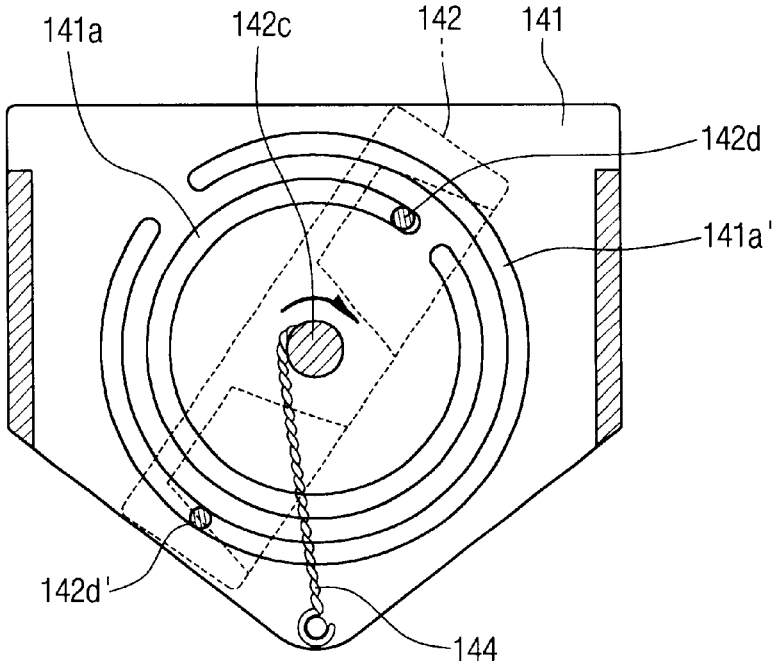
FIG. 7 is a view taken along line A—A of FIG. 5, showing an operational state that the ice tray is rotated clockwise to separate ices from the ice tray in accordance with one embodiment of the present invention.

In other words, as shown in FIG. 7, when the ice tray 142 is rotated clockwise, the end portion the first guide groove 141*a* limits the rotation of the first stopping protrusion 142*d*.

Figure 8:
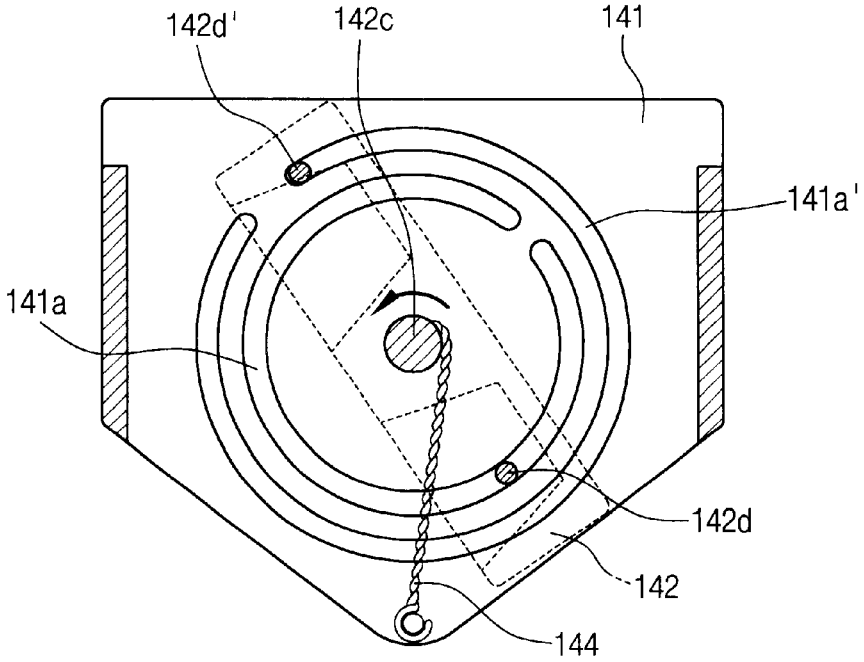
FIG. 8 is a view taken along line A—A of FIG. 5, showing an operational state that the ice tray is rotated counterclockwise to separate ices from the ice tray in accordance with one embodiment of the present invention.

In addition, as shown in FIG. 8, when the ice tray 142 is rotated counterclockwise, the end portion of the second guide groove 141*a*' limits the rotation of the second stopping protrusion 142*d*'.

With reference to FIG. 6, an elastic member 144 is installed between the ice tray 142 and the case 141.

The elastic member 144 is a part to provide a restoration force so that the ice tray 142 can be restored after being rotated. When the ice tray 142 is rotated clockwise or counterclockwise, the elastic member 144 is wound at the rotational shaft 142*c*, thereby retaining tensile elastic force.

The operation of the ice-making device constructed as described in accordance with one embodiment of the present invention will now be explained.

After water is filled in the ice cubes 142*a* of the ice tray 142, it is kept in the freezing chamber. When a predetermined time elapses, the water filled in the ice cubes 142*a* is frozen to make pieces of ice.

In order to use the formed pieces of ice, a user rotates the knob 143 of the ice-making unit 140 leftward or rightward, so that the pieces of ice can be separated from the ice tray 142.

Namely, when the user rotates the ice tray 142 clockwise, the first and the second stopping protrusions 142*d* and 142*d*' are rotated clockwise along the first and the second guide grooves 141*a* and 141*a*' of the case 141.

When the ice tray 142 is kept being rotated, as shown in FIG. 7, the first stopping protrusion 142*d* is caught by the end portion of the first guide groove 141*d*.

At this time, even though the rear portion of the ice tray 142 is limited in its rotating, the front portion thereof is not limited. Thus, when the user applies a stronger force thereto to rotate it, the ice tray 142 is twisted, and thus, the pieces of ice frozen in the ice cubes 142*a* are separated from the ice tray 142 and fall down to the ice storing box positioned at the lower side.

When the ice tray 142 is rotated, the elastic member 144 installed between the rotational shaft 142*c* and the case 141 is wound tense at the rotational shaft 142*c*. And when the user lets go of the knob 143, the elastic member is restored so that the ice tray 142 is restored to the horizontal state.

Conversely, if the knob 143 of the ice tray 142 is rotated counterclockwise, as the ice tray 142 is rotated counterclockwise, the first and the second stopping protrusions 142*d* and 142*d*' are rotated counterclockwise along the first and the second guide grooves 141*a* and 141*a*' of the case 141.

As the ice tray 142 is kept being rotated counterclockwise, as shown in FIG. 8, the second stopping protrusion 142*d*' is caught by the end portion of the second guide groove 141*d*'.

At this time, since the front portion of the ice tray 142 is not limited while the rear portion of the ice tray 142 is no more rotated, if the user applies a force stronger to rotate the ice tray, likewise the case that the ice tray is rotated clockwise, the ice tray 142 is twisted, so that the pieces of ice frozen in the ice cubes 142*a* are separated therefrom and fall down into the ice storing box.

As for the elastic member 144 which has been wound counterclockwise at the rotational shaft 142*c* according to the rotation of the ice tray 142, when the user lets go of the knob 143, the elastic member is restored to restore the ice tray 142 to a horizontal state.

As so far described, a technical gist of the present invention which has the ice separation structure adopting the twisting method of the ice tray 142 to separate pieces of ice from the ice-making unit of a refrigerator is that the ice tray 142 is rotatable in both directions, that is, clockwise and counterclockwise.

Many other modifications to the present invention can be made.

For example, in the first guide groove 141*a* and the second guide groove 142*a*', if one stopping protrusion (142*d* or 142*d*') is limited from rotating, the other stopping protrusion (142*d*' or 142*d*) can be rotated.

At this time, since only one stopping protrusion (142*d* or 142*d*') supports twisting of the ice tray 142, a great load is applied to the stopping protrusion (142*d*' or 142*d*).

However, unlike the former embodiment, if it is constructed such that the other stopping protrusion 142*d*' or 142*d* is also formed to be limited from rotating when one stopping protrusion 142*d* or 142*d*' are limited in the first and the second guide grooves 141*a* and 141*a*', the support force supporting the twisting of the ice tray 142 can be distributed. Thus, the stopping protrusions 142*d* and 142*d*' can be prevented from damaging.

Unlike the former embodiment of the present invention in which the stopping protrusions 142*d* and 142*d*' and the guide grooves 141*a* and 141*a*' are formed at the rear face of the ice tray 142 and at the corresponding inner face of the rear side of the case 141, the stopping protrusions 142*d* and 142*d*' may be formed at the front face of the ice tray 142 and the guide grooves 141*a* and 141*a*' may be formed to be corresponded thereto.

In addition, it would be also possible to form the stopping protrusions 142*d* and 142*d*' at both front and rear faces of the ice tray 142 and the guide grooves 141*a* and 141*a*' to be corresponded thereto.

Figure 9:
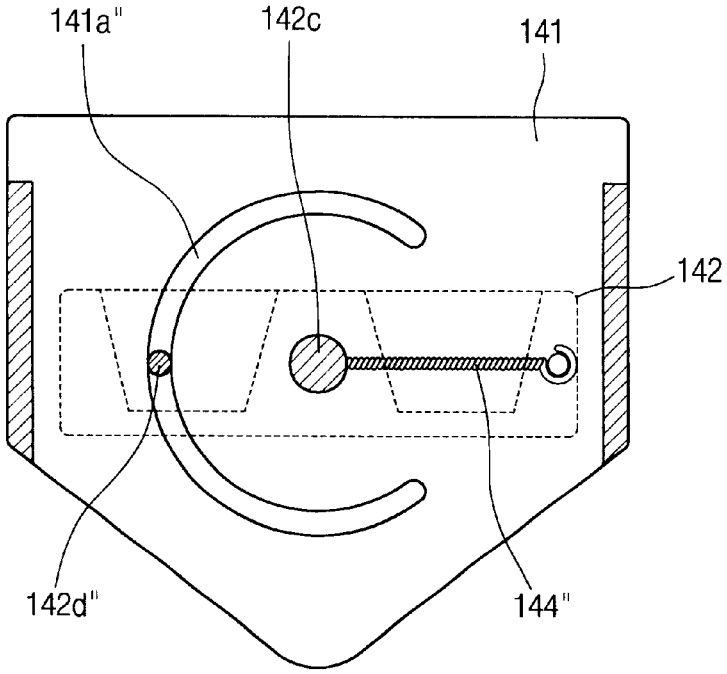
FIG. 9 is a schematic view showing an ice-making device of a refrigerator in accordance with another embodiment of the present invention.

Unlike the former embodiment in which the pair of stopping protrusions are formed and the corresponding pair of guide groove are formed, in the second embodiment of the present invention, as shown in FIG. 9, only one stopping protrusion 142*d*" is formed at one side of the ice tray 142 and a corresponding guide groove 141*a*" of the case 14 may be formed with a suitable length.

And, in the opposite of the stopping protrusion 142*d*", an elastic member 144" is installed between the rotational shaft 142*c* and the case 141, so that the ice tray 142 may receive a restoring force and be restored to a horizontal state after being rotated clockwise and counterclockwise.

As so far described, according to the ice-making device of a refrigerator in accordance with the present invention, since the ice tray can be rotated clockwise or counterclockwise according to a user's selection, the pieces of ice can be easily from the ice tray, ensuring that the user can separate the pieces of ice more conveniently.

In addition, since the frozen ice can be separated by rotating the ice tray in a desired direction, an interference of a neighboring structure possibly caused in the course of rotating the ice-making unit can be reduced, so that an installation position of the ice-making unit in a freezing chamber can be freely selected.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An ice-making device comprising:

a case;

an ice tray having a plurality of ice cube partitions and being installed on the case such that the ice tray is rotatable in the clockwise and counterclockwise directions in the case; and a rotation stopping unit coupled to the ice tray and configured to limit a rotation of a first end of the ice tray in the clockwise and counterclockwise directions to a predetermined angular amount such that when the ice tray is rotated the predetermined angular amount in the clockwise or counterclockwise directions, ice can be ejected from the ice cube partitions of the ice tray, wherein the rotation stopping unit comprises:

at least one stopping protrusion formed on the ice tray, and at least one guide groove formed on the case and configured to receive the at least one stopping protrusion, wherein the at least one guide groove is configured to block further rotation of the first end of the ice tray after the ice tray has been rotated the predetermined angular amount in the clockwise or counterclockwise directions.

2. The device of claim 1, wherein the at least one stopping protrusion and the at least one guide groove comprise a single protrusion formed on the ice tray and a single guide groove formed on the case.

3. The device of claim 1, wherein the at least one stopping protrusion and the at least one guide groove comprise a plurality of stopping protrusions formed on the ice tray and a corresponding plurality of guide grooves formed on the case.

4. The device of claim 3, wherein the plurality of stopping protrusions include a first stopping protrusion and a second stopping protrusion which have different distances from a rotational center of the ice tray, and the plurality of guide grooves include a first guide groove and a second guide groove into which the first stopping protrusion and the second stopping protrusion are inserted.

5. The device of claim 4, wherein the first guide groove limits a rotation of the first stopping protrusion when the ice tray is rotated clockwise, and the second guide groove limits a rotation of the second stopping protrusion when the ice tray is rotated counterclockwise.

6. The device of claim 1, wherein a knob or a handle protrudes from a front side of the ice tray, and the rotation stopping unit is installed at rear side of the ice tray and the case.

7. The device of claim 6, wherein the at least one stopping protrusion is formed on a rear side of the ice tray; and the at least one guide groove is formed on an inner side of the case and configured so that the stopping protrusion is inserted thereto.

8. An ice-making device comprising:

a case;

an ice tray having a plurality of ice cube partitions and being installed on the case such that the ice tray is rotatable in the clockwise and counterclockwise directions in the case; and a rotation stopping unit coupled to the ice tray and configured to limit a rotation of a first end of the ice tray in the clockwise and counterclockwise directions to a predetermined angular amount such that when the ice tray is rotated the predetermined angular amount in the clockwise or counterclockwise directions, ice can be ejected from the ice cube partitions of the ice tray, and further comprising an elastic unit attached between the case and the ice tray and configured to provide a biasing force that tends to return the ice tray to a horizontal state after the ice tray has been rotated clockwise or counterclockwise.

9. The device of claim 8, wherein the ice tray includes a rotational shaft inserted into the case, and wherein the elastic unit is fixed to the rotational shaft and the case.

10. The device of claim 8, wherein the rotation stopping unit comprises:

at least one stopping protrusion formed on the ice tray; and at least one guide groove formed on the case and configured to receive the at least one stopping protrusion, wherein the at least one guide groove is configured to block further rotation of the first end of the ice tray after the ice tray has been rotated the predetermined angular amount in the clockwise or counterclockwise directions.

11. The device of claim 10, wherein the at least one stopping protrusion and the at least one guide groove comprise a single protrusion formed on the ice tray and a single guide groove formed on the case.

12. The device of claim 10, wherein the at least one stopping protrusion and the at least one guide groove comprise a plurality of stopping protrusions formed on the ice tray and a corresponding plurality of guide grooves formed on the case.

13. The device of claim 12, wherein the plurality of stopping protrusions include a first stopping protrusion and a second stopping protrusion which have different distances from a rotational center of the ice tray, and the plurality of guide grooves include a first guide groove and a second guide groove into which the first stopping protrusion and the second stopping protrusion are inserted.

14. The device of claim 13, wherein the first guide groove limits a rotation of the first stopping protrusion when the ice tray is rotated clockwise, and the second guide groove limits a rotation of the second stopping protrusion when the ice tray is rotated counterclockwise.

15. An ice making device comprising:

a case;

an ice cube tray that is rotatably installed in the case such that the ice cube tray can be rotated in the clockwise or counterclockwise directions to eject ice cubes from the ice cube tray; and a rotation stopping unit configured to limit the amount that a first end of the ice cube tray can be rotated in the clockwise and counterclockwise directions, wherein the rotation stopping unit comprises:

a plurality of stopping protrusions formed on the ice cube tray, wherein each of the plurality of stopping protrusions are located on the ice cube tray at different distances from a rotational axis of the ice cube tray; and a corresponding plurality of guide grooves formed on the case, wherein each of the plurality of guide grooves is configured to receive one of the plurality of stopping protrusions.

16. The ice making device of claim 15, wherein the plurality of guide grooves have closed ends that limit the amount that the stopping protrusions can move as the ice cube tray is rotated, thereby limiting the amount that the first end of the ice cube tray can rotate in the clockwise and counterclockwise directions.

17. The ice making device of claim 16, wherein the stopping protrusions and guide grooves are formed such that as the ice cube tray is rotated in the clockwise or counterclockwise directions, each of the stopping protrusions will abut against a closed end of a corresponding guide groove at approximately the same time.

18. The ice making device of claim 15, wherein the ice cube tray and the rotation stopping unit are configured such that as the ice cube tray is rotated in the clockwise or counterclockwise directions, at least one of the plurality of stopping protrusions will abut a closed end of a corresponding guide groove after the first end of the ice cube tray has rotated a predetermined angular amount necessary to at least partially invert the ice cube tray, and wherein further rotation of a second end of the ice cube tray will cause the ice cube tray to be twisted, said twisting movement causing ice cubes to fall out of the tray.

19. A refrigerator having an ice making device that includes a case, an ice cube tray that is rotatably installed in the case, and a rotation stopping unit configured to stop rotation of a first end of the ice cube tray once the first end of the ice cube tray has been rotated in either the clockwise or counterclockwise directions by an angular amount necessary to at least partially invert the ice cube tray, wherein the improvement comprises:

a rotation stopping unit that includes:

at least one stopping protrusion formed on the ice tray, and at least one guide groove formed on the case and configured to receive the at least one stopping protrusion, wherein the at least one guide groove is configured to block further rotation of the first end of the ice tray after the ice tray has been rotated the predetermined angular amount in the clockwise or counterclockwise directions.

* * * * *